US011724900B2

(12) United States Patent
Lawrence et al.

(10) Patent No.: US 11,724,900 B2
(45) Date of Patent: Aug. 15, 2023

(54) SHEET CONVEYING DEVICE AND SHEET CONVEYING METHOD

(71) Applicant: TOSHIBA TEC KABUSHIKI KAISHA, Tokyo (JP)

(72) Inventors: Michael W Lawrence, Lexington, KY (US); Gary L Noe, Lexington, KY (US); Mikio Yamamoto, Izunokuni Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 193 days.

(21) Appl. No.: 17/372,924

(22) Filed: Jul. 12, 2021

(65) Prior Publication Data

US 2021/0339972 A1 Nov. 4, 2021

Related U.S. Application Data

(63) Continuation of application No. 16/363,371, filed on Mar. 25, 2019, now Pat. No. 11,091,338.

(51) Int. Cl.
*B65H 9/00* (2006.01)
*B65H 5/06* (2006.01)
(Continued)

(52) U.S. Cl.
CPC ..... *B65H 9/008* (2013.01); *B65H 5/062* (2013.01); *B65H 5/36* (2013.01); *B65H 7/06* (2013.01);
(Continued)

(58) Field of Classification Search
CPC ..... B65H 9/002; B65H 9/004; B65H 9/006; B65H 9/008; B65H 5/062; B65H 5/36;
(Continued)

(56) References Cited

U.S. PATENT DOCUMENTS 5,246,224 A 9/1993 Matsuno et al.
5,277,415 A 1/1994 Kinoshita et al.
(Continued)

FOREIGN PATENT DOCUMENTS

EP 0529538 A1 3/1993
JP 2007-137645 A 6/2007
(Continued)

OTHER PUBLICATIONS

Chinese First Office Action dated Oct. 19, 2022, mailed in counterpart Chinese Application No. 201911142313.X, with English translation (15 pages).
(Continued)

*Primary Examiner* — Jeremy R Severson
(74) *Attorney, Agent, or Firm* — Kim & Stewart LLP

(57) ABSTRACT

A sheet conveying device includes a first roller, a second roller, and a controller. The first roller is configured to rotate in a forward direction for sheet conveyance along a sheet conveying direction. The second roller is disposed downstream with respect to the first roller in the sheet conveying direction and configured to rotate in a forward direction along the sheet conveying direction and in a reverse direction. The controller is configured to control the second roller to rotate in the reverse direction at a timing when a leading end of a sheet that is nipped and conveyed by the first roller reaches a nip of the second roller.

20 Claims, 17 Drawing Sheets

(51) Int. Cl.

| | |
|---|---|
| ***B65H 5/36*** | (2006.01) |
| ***B65H 7/06*** | (2006.01) |
| ***B65H 7/18*** | (2006.01) |
| ***B65H 20/36*** | (2006.01) |
| *B65H 20/02* | (2006.01) |

(52) U.S. Cl.
CPC ..... *B65H 7/18* (2013.01); *B65H 9/002* (2013.01); *B65H 20/36* (2013.01); *B65H 20/02* (2013.01); *B65H 2511/13* (2013.01); *B65H 2513/10* (2013.01); *B65H 2513/50* (2013.01); *B65H 2553/40* (2013.01); *B65H 2553/80* (2013.01)

(58) Field of Classification Search
CPC ..... B65H 7/06; B65H 7/18; B65H 20/36; B65H 2553/80
See application file for complete search history.

(56) References Cited

U.S. PATENT DOCUMENTS

| | | | | |
|---|---|---|---|---|
| 6,257,692 | B1 | 7/2001 | Yokoi et al. | |
| 9,126,791 | B2 * | 9/2015 | Inoue | B65H 3/44 |
| 9,193,551 | B2 | 11/2015 | Kamijo et al. | |
| 10,054,894 | B2 | 8/2018 | Mine et al. | |
| 11,091,338 | B2 * | 8/2021 | Lawrence | B65H 20/36 |
| 2015/0378299 | A1 | 12/2015 | Beck et al. | |
| 2016/0176667 | A1 | 6/2016 | Mori | |

FOREIGN PATENT DOCUMENTS

| | | | |
|---|---|---|---|
| JP | 2014-118238 | A | 6/2014 |
| JP | 2015-165279 | A | 9/2015 |

OTHER PUBLICATIONS

Extended European Search Report dated Jun. 8, 2020, mailed in counterpart European Patent Application No. 19209985.1, 9 pages.

* cited by examiner

SHEET CONVEYING DEVICE AND SHEET CONVEYING METHOD

CROSS-REFERENCE TO RELATED APPLICATIONS

This application is a continuation of U.S. patent application Ser. No. 16/363,371, filed on Mar. 25, 2019, the entire contents of each of which are incorporated herein by reference.

FIELD

Embodiments described herein relate generally to a sheet conveying device and a sheet conveying method.

BACKGROUND

An image processing apparatus including a sheet conveying device is used. The sheet conveying device aligns and conveys a sheet supplied in an inclined state. Improvement of aligning performance is desirable for the sheet conveying device.

DETAILED DESCRIPTION

A sheet conveying device according to an embodiment includes a first roller, a second roller, and a controller. The first roller is configured to rotate in a forward direction for sheet conveyance along a sheet conveying direction. The second roller is disposed downstream with respect to the first roller in the sheet conveying direction and configured to rotate in a forward direction along the sheet conveying direction and in a reverse direction. The controller is configured to control the second roller to be rotating in the reverse direction at timing when a leading end of a sheet nipped and conveyed by the first roller reaches a nip of the second roller.

Sheet conveying devices and sheet conveying methods according to embodiments are described below with reference to the drawings.

In this application, X direction, Y direction, and Z direction are defined as follows. Z direction is a conveying direction of a sheet S. +Z direction is a direction in which the sheet S moves to a downstream side in the conveying direction. −Z direction is a direction in which the sheet S moves to an upstream side in the conveying direction. Y direction is a width direction of the sheet S orthogonal to Z direction. X direction is a thickness direction of the sheet S orthogonal to Z direction and Y direction.

First Embodiment

Figure 1:
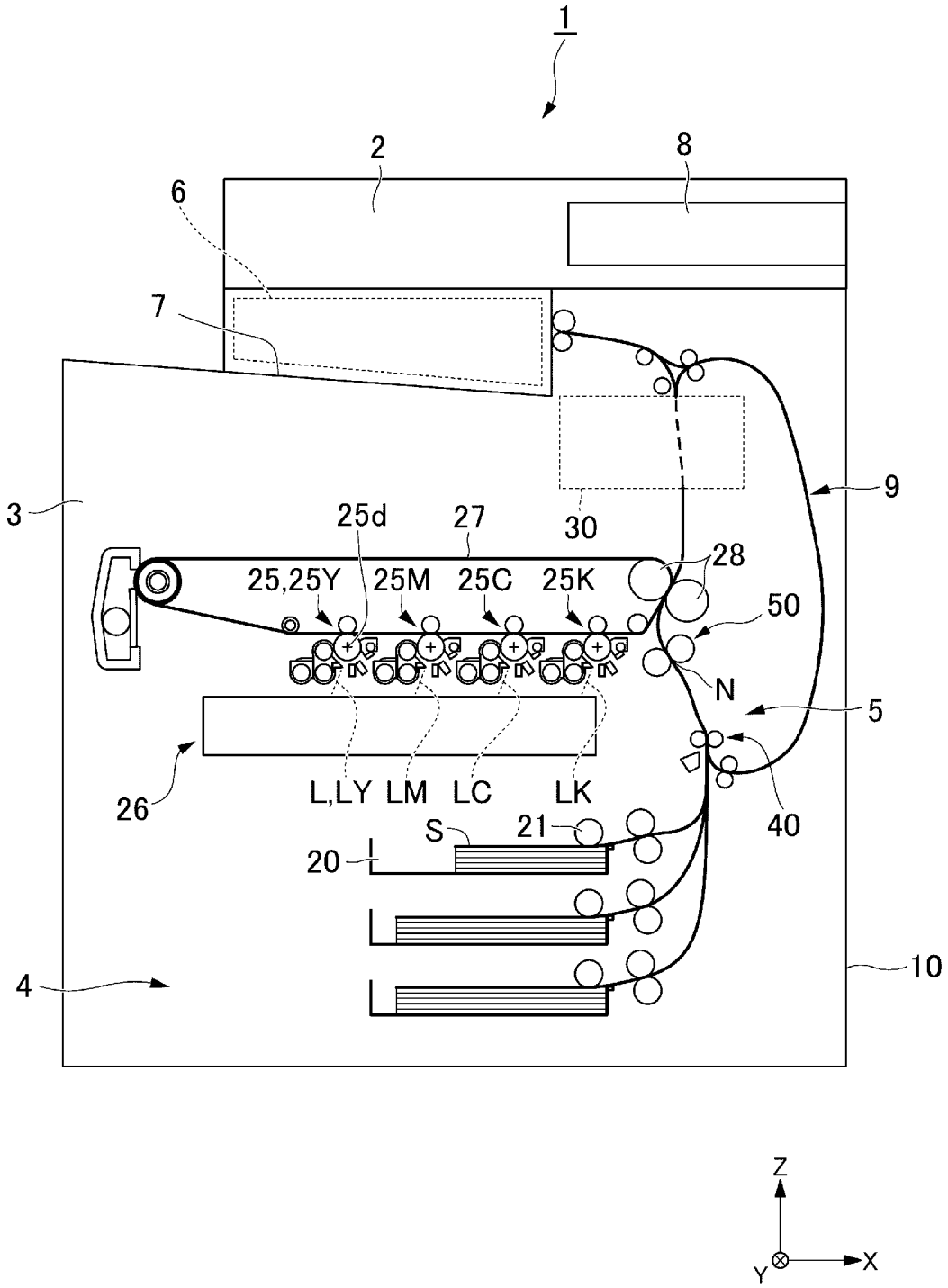
FIG. 1 schematically illustrates a configuration of an image processing apparatus according to a first embodiment.

FIG. 1 schematically illustrates a configuration of an image processing apparatus according to a first embodiment.

The image processing apparatus according to the first embodiment is an image forming apparatus 1. The image forming apparatus 1 performs processing for forming an image on a sheet (paper) S.

The image forming apparatus 1 includes a housing 10, a scanner section 2, an image forming unit 3, a sheet supplying section 4, a sheet conveying device 5, a paper discharge tray 7, a reversing unit 9, a control panel 8, and an apparatus control section 6.

The housing 10 forms the exterior of the image forming apparatus 1.

The scanner section 2 obtains image information of a copying target object based on light and shade of light and generates an image signal. The scanner section 2 outputs the generated image signal to the image forming unit 3.

The sheet supplying section 4 supplies sheets S one by one to the sheet conveying device 5, according to timing when the image forming unit 3 forms a toner image. The sheet supplying section 4 includes sheet storing sections 20 and pickup rollers 21.

The sheet storing sections 20 store sheets S of predetermined sizes and types.

The pickup rollers 21 extract the sheets S one by one from the sheet storing sections 20. The pickup rollers 21 supply the extracted sheets S to the sheet conveying device 5.

The sheet conveying device 5 conveys the sheets S supplied from the sheet supply section 4 to the image forming unit 3. Details of the sheet conveying device 5 are explained below.

The image forming unit 3 forms an output image (hereinafter referred to as toner image) with a recording agent such as toner on the basis of an image signal received from the scanner section 2 or the outside. The image forming unit 3 transfers the toner image onto the surface of the sheet S. The image forming unit 3 heats and pressurizes the toner image on the surface of the sheet S to fix the toner image on the sheet S.

The image forming unit 3 includes a plurality of image forming sections 25, a laser scanning unit 26, an intermediate transfer belt 27, a transfer section 28, and a fixing device 30.

The image forming sections 25 include photoconductive drums 25*d*. The image forming sections 25 form toner images corresponding to the image signal from the scanner section or the outside on the photoconductive drums 25*d*. A plurality of image forming sections 25Y, 25M, 25C, and 25K form toner images by toners of yellow, magenta, cyan, and black, respectively.

Chargers, developing devices, and the like are disposed around the photoconductive drums 25*d*. The chargers charge the surfaces of the photoconductive drums 25*d*.

The laser scanning unit 26 scans a laser beam L on the charged photoconductive drums 25*d* to expose the photoconductive drums 25*d* with the laser beam L. The laser scanning unit 26 exposes the photoconductive drums 25*d* of the image forming sections 25Y, 25M, 25C, and 25K of the colors with respective laser beams LY, LM, LC, and LK. Consequently, the laser scanning unit 26 forms electrostatic latent images on the photoconductive drums 25*d*.

The developing devices store developers including the toners of yellow, magenta, cyan, and black. The developing devices develop the electrostatic latent images on the photoconductive drums 25*d*. As a result, toner images of the toners of the colors are formed on the photoconductive drums 25*d*.

The toner images on the surfaces of the photoconductive drums 25*d* are primarily transferred onto the intermediate transfer belt 27.

The transfer section 28 transfers the toner images, which are primarily transferred onto the intermediate transfer belt 27, onto the surface of the sheet S at a secondary transfer position.

The fixing device 30 heats and pressurizes the toner images transferred onto the sheet S and fixes the toner images on the sheet S.

The reversing unit 9 reverses the sheet S in order to form an image on the rear surface of the sheet S. The reversing unit 9 reverses the sheet S discharged from the fixing device 30 by switching back the sheet S. The reversing unit 9 conveys the reversed sheet S toward the sheet conveying device 5.

The discharged sheet S having the image formed thereon is placed on the paper discharge tray 7.

The control panel 8 is a part of an input section to which an operator inputs information for operating the image forming apparatus 1. The control panel 8 includes a touch panel and various operation keys.

Figure 2:
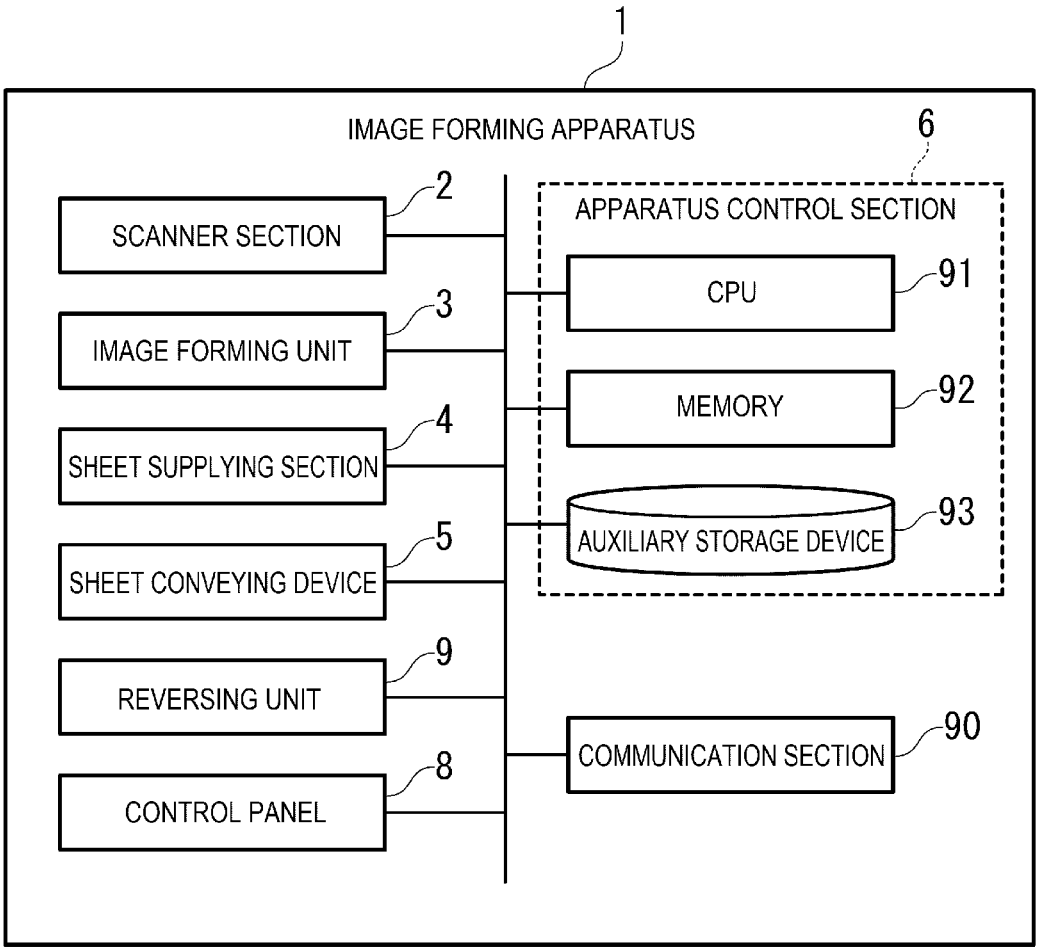
FIG. 2 illustrates a functional configuration of the image processing apparatus.

FIG. 2 illustrates a functional configuration of the image forming apparatus according to the first embodiment. The image forming apparatus 1 includes a CPU (Central Processing Unit) 91, a memory 92, and an auxiliary storage device 93 connected via a bus. The image forming apparatus 1 executes computer programs. The image forming apparatus 1 functions as an apparatus including the scanner section 2, the image forming unit 3, the sheet supplying section 4, the sheet conveying device 5, the reversing unit 9, the control panel 8, and a communication section 90 according to the execution of the computer programs.

The CPU 91 functions as the apparatus control section 6 by executing computer programs stored in the memory 92 and the auxiliary storage device 93. The apparatus control section 6 controls the operations of the functional sections of the image forming apparatus 1.

The auxiliary storage device 93 is configured using a storage device such as a magnetic hard disk device or a semiconductor storage device. The auxiliary storage device 93 stores information.

The communication section 90 includes a communication interface for connecting the image forming apparatus 1 to an external apparatus. The communication section 90 communicates with the external apparatus via a communication interface.

The sheet conveying device 5 is described below in detail.

Figure 3:
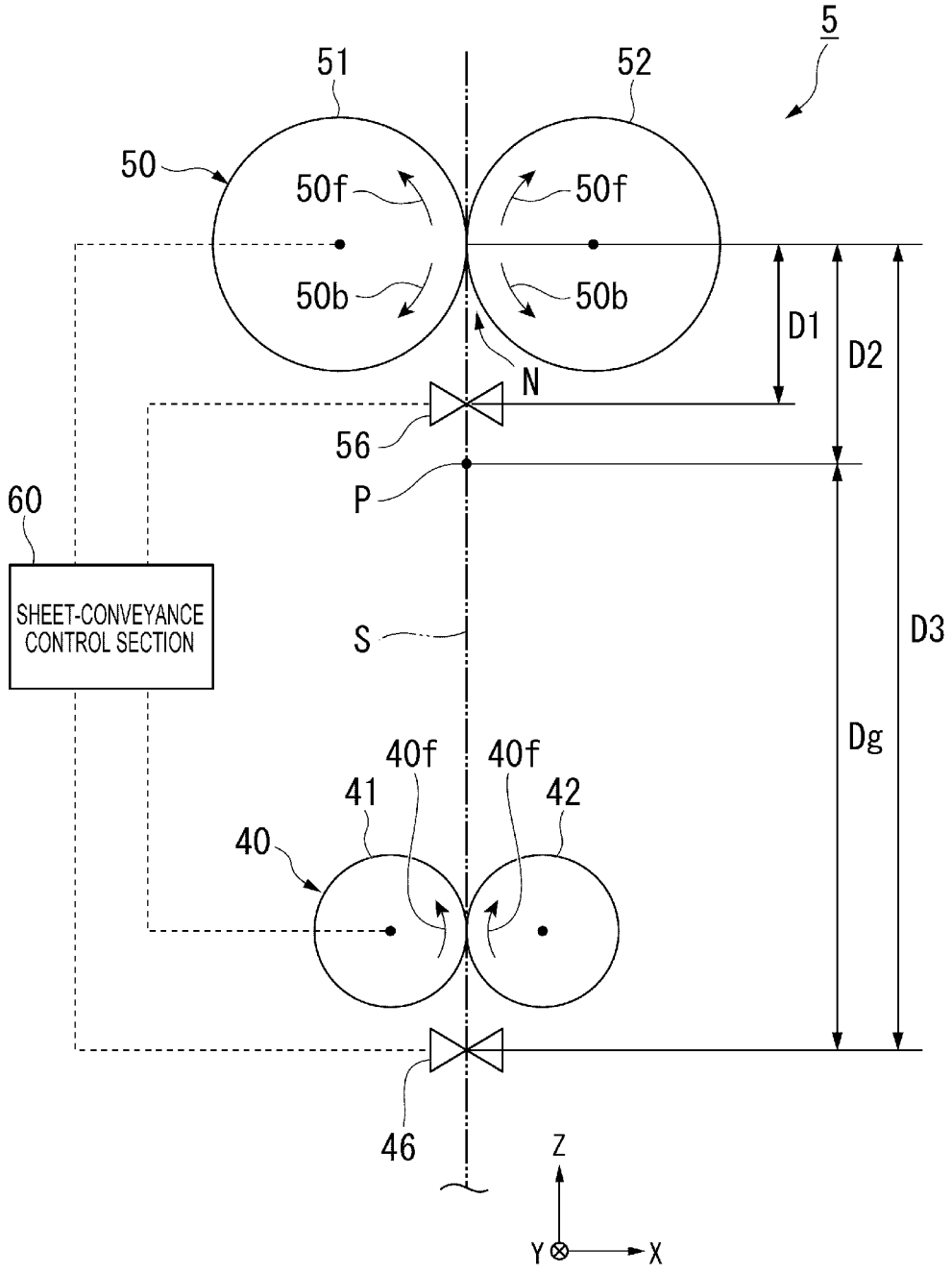
FIG. 3 schematically illustrates a configuration of a sheet conveying device according to the first embodiment.

FIG. 3 schematically illustrates a configuration of the sheet conveying device 5 according to the first embodiment.

The sheet conveying device 5 includes a conveyance roller (an upstream side roller) 40, an alignment roller (a downstream side roller or a registration roller) 50, a downstream side sensor 56, an upstream side sensor 46, and a sheet-conveyance control section (a control section) 60.

The conveyance roller 40 includes a driving roller 41 and a driven roller 42. At least one of a pair of rollers 41 and 42 is urged toward the other. The driving roller 41 is driven to rotate. The driven roller 42 rotates according to the rotation of the driving roller 41.

The conveyance roller 40 is capable of performing normal rotation 40*f* for moving the sheet S in +Z direction. The conveyance roller 40 holds the sheet S with the pair of rollers 41 and 42 and conveys the sheet S.

The alignment roller 50 is disposed in +Z direction of the conveyance roller 40. The alignment roller 50 includes a first roller 51 and a second roller 52. At least one of a pair of rollers 51 and 52 is urged toward the other. Consequently, a nip N is formed between the pair of rollers 51 and 52. At least one of the pair of rollers 51 and 52 is driven to rotate.

The alignment roller 50 is capable of performing forward rotation 50*f* for moving the sheet S in +Z direction and reverse rotation 50*b* for moving the sheet S in −Z direction. Speed of the forward rotation 50*f* of the alignment roller 50 is higher than speed of the reverse rotation 50*b* of the alignment roller 50.

Figure 4:
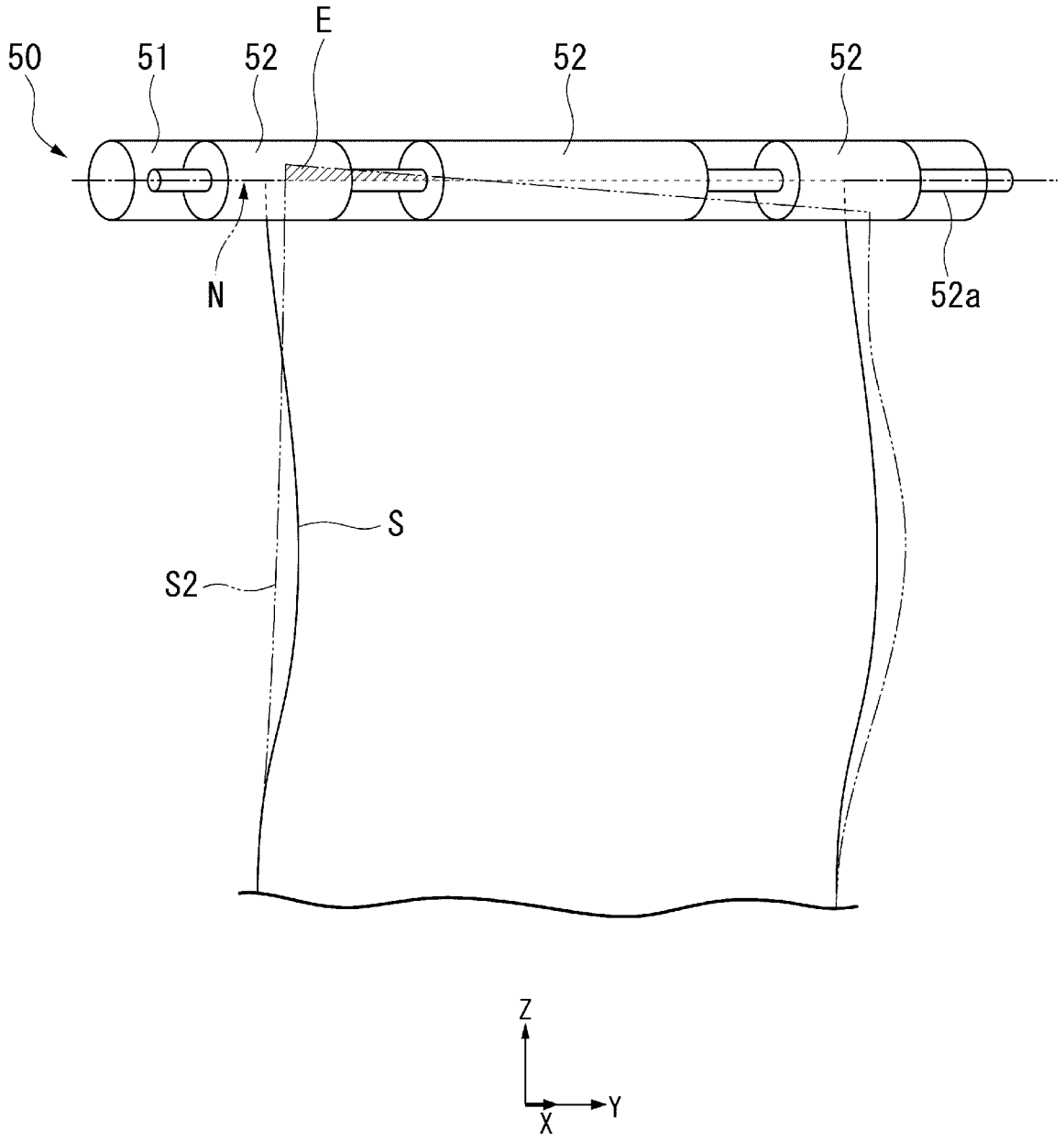
FIG. 4 is a diagram to explain aligning.

FIG. 4 is a diagram to explain aligning and illustrates a perspective view of the sheet conveying device according to the first embodiment.

The outer circumferential surface of the first roller 51 is formed of a metal material or the like. The first roller 51 is uniformly formed along a rotation axis direction.

The outer circumferential surface of the second roller 52 is formed of a rubber material or the like. The second roller 52 is dividedly formed along the rotation axis direction. The divided second rollers 52 are coupled to one another by a shaft 52*a*. The shaft 52*a* is disposed along a rotation axis of the second roller 52. The divided second rollers 52 integrally rotate according to rotation of the shaft 52*a*.

A guide (not illustrated in FIG. 3) for guiding the sheet S along a conveying path is disposed between the conveyance roller 40 and the alignment roller 50. The guide is disposed in +X direction and −X direction of the conveying path of the sheet S. The guide is formed of a resin material or the like.

A mylar (not illustrate in FIG. 3) for guiding the sheet S to the nip N is disposed between the guide and the conveyance roller 40 and the alignment roller 50. The mylar is disposed in +X direction and −X direction of the conveying path of the sheet S. The mylar is formed of a resin film or the like.

The guide and the mylar are employed define a bending direction of the sheet S.

As illustrated in FIG. 4, the sheet S may be conveyed to the alignment roller 50 in a state in which the leading end in +Z direction of the sheet S (hereinafter sometimes simply referred to as "leading end of the sheet S") is inclined with respect to the nip N (hereinafter sometimes simply referred to as "inclined"). The alignment roller 50 restricts the conveyance of the sheet S in the nip N and bends the sheet S in X direction. The bend is formed in the sheet S, whereby the inclination of the leading end of the sheet S is aligned by the nip N.

The alignment roller 50 holds the aligned sheet S with the pair of rollers 51 and 52 and conveys the sheet S.

As illustrated in FIG. 3, the downstream side sensor 56 is disposed in −Z direction of the alignment roller 50. The downstream side sensor 56 is an optical sensor or the like. The downstream side sensor 56 detects passage of the leading end of the sheet S and outputs a downstream-side detection signal. The downstream side sensor 56 is disposed in a position apart from the nip N of the alignment roller 50 in −Z direction by a first distance D1.

The upstream side sensor 46 is disposed in −Z direction of the alignment roller 50 and the conveyance roller 40. The upstream side sensor 46 is an optical sensor or the like. The upstream side sensor 46 detects passage of the leading end of the sheet S and outputs an upstream-side detection signal. The upstream side sensor 46 is disposed in a position apart from the nip N of the alignment roller 50 in −Z direction by a third distance D3.

The sheet-conveyance control section 60 is a part of the apparatus control section 6 (see FIG. 2). The sheet-conveyance control section 60 controls the operation of the sheet conveying device 5.

The sheet-conveyance control section 60 causes the conveyance roller 40 to perform the forward rotation 40*f* or stops the conveyance roller 40. The sheet-conveyance control section 60 causes the alignment roller 50 to perform the forward rotation 50*f* or the reverse rotation 50*b* or stops the alignment roller 50.

The sheet-conveyance control section 60 starts the reverse rotation 50*b* of the alignment roller 50 at a point in time when the leading end of the sheet S reaches a predetermined position P. The predetermined position P is a position apart from the nip N of the alignment roller 50 in −Z direction by a second distance D2. The sheet-conveyance control section 60 receives the upstream-side detection signal output from the upstream side sensor 46. The sheet-conveyance control section 60 determines that the leading end in +Z direction of the sheet S reaches the predetermined position after a predetermined time period from the reception of the upstream-side detection signal. The predetermined time period is a time period during which the conveyance roller 40 performs the normal rotation 40*f* to convey the sheet S in +Z direction by a difference distance Dg. The difference distance Dg is a difference between the third distance D3 and the second distance D2.

The sheet-conveyance control section 60 receives a downstream-side detection signal output from the downstream side sensor 56. The sheet-conveyance control section 60 rotates the conveyance roller 40 to convey the sheet S in +Z direction by a predetermined distance after receiving the downstream-side detection signal. The predetermined distance is a distance obtained by adding a bend forming distance to the first distance D1. The conveyance roller 40 conveys the sheet S beyond the first distance D1, whereby a bend is formed in the sheet S. The bend forming distance is a distance in which a bend having desired size is formed in the sheet S.

The sheet-conveyance control section 60 continues the reverse rotation 50*b* of the alignment roller 50 while the conveyance roller 40 conveys the sheet S by the predetermined distance. That is, the sheet-conveyance control section 60 reversely rotates the alignment roller 50 in a state in which the conveyance roller 40 is rotated in a forward direction. The sheet-conveyance control section 60 reversely rotates the alignment roller 50 in a state in which the leading end of the sheet S is in contact with the alignment roller 50 and a bend is formed in the sheet S.

The sheet-conveyance control section 60 changes the speed of the reverse rotation 50*b* of the alignment roller 50 when a thin first sheet is conveyed and when a thick second sheet is conveyed. The speed of the reverse rotation 50*b* of the alignment roller 50 in conveying the first sheet is referred to as a first speed. The speed of the reverse rotation 50*b* of the alignment roller 50 in conveying the second sheet is referred to as a second speed. The sheet-conveyance control section 60 sets the second speed lower than the first speed. As explained above, the sheet-conveyance control section 60 reversely rotates the alignment roller 50 in a state in which the leading end of the sheet S is in contact with the alignment roller 50. At this time, the thick second sheet is likely to be separated in the thickness direction. The separation of the sheet is prevented by setting the second speed lower than the first speed.

The sheet-conveyance control section 60 normally rotates the alignment roller 50 and the conveyance roller 40 at predetermined timing and conveys the sheet S to the image forming unit 3. The predetermined timing is timing when the conveyance of the sheet S is started according to the transfer of the toner image onto the sheet S by the image forming unit 3.

A sheet conveying method using the sheet conveying apparatus in the first embodiment is explained below in detail.

Figure 5:
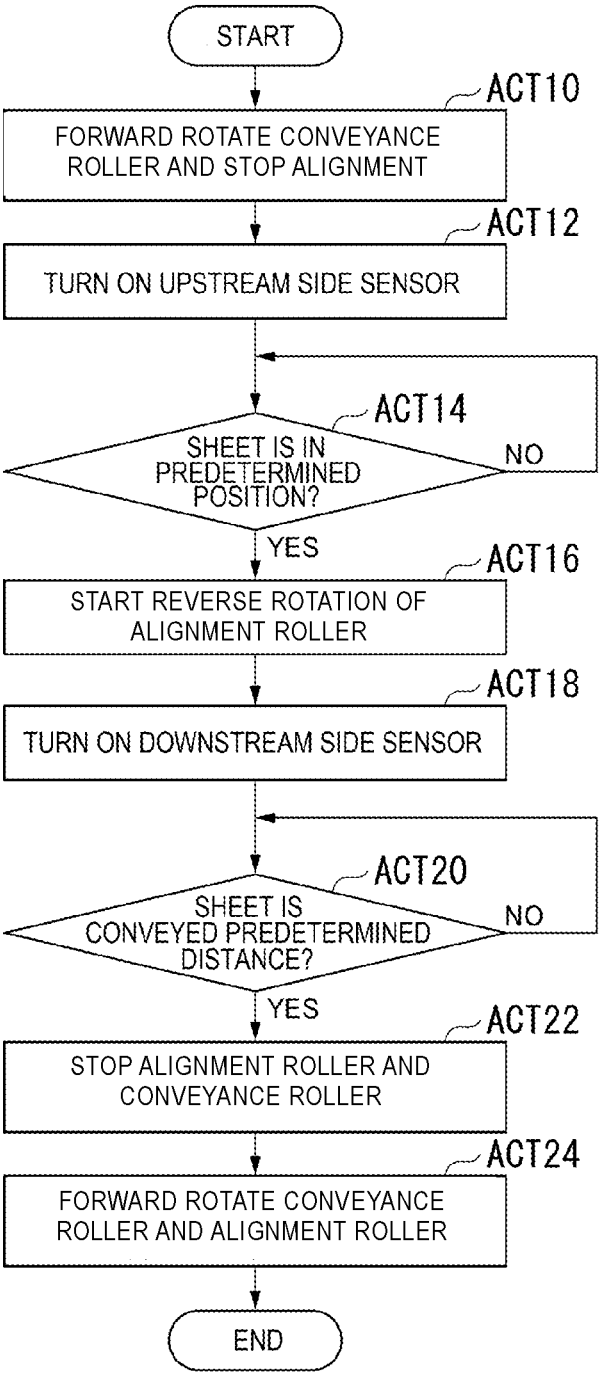
FIG. 5 is a flowchart of a sheet conveying method according to the first embodiment.

FIG. 5 is a flowchart of the sheet conveying method according to the first embodiment. FIGS. 6-11 illustrate a sequence of sheet conveyance according to the sheet conveying method of the first embodiment.

Figure 6:
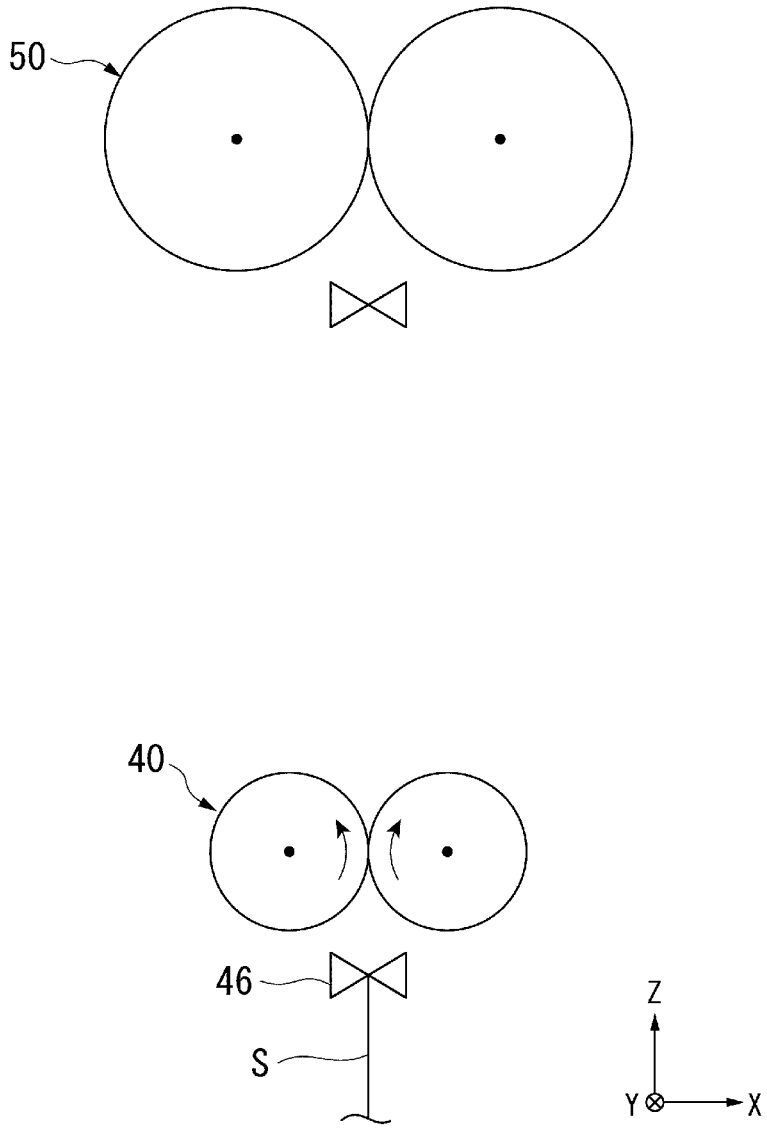
FIGS. 6-11 illustrate a sequence of sheet conveyance according to the sheet conveying method.

When receiving a printing command, the sheet-conveyance control section 60 conveys the sheet S in +Z direction. That is, as illustrated in FIG. 6, the sheet-conveyance control section 60 rotates the conveyance roller 40 in the forward direction. At this time, the sheet-conveyance control section 60 stops the alignment roller 50 (Act 10).

As illustrated in FIG. 6, if the leading end of the sheet S reaches the upstream side sensor 46, the upstream side sensor 46 is turned on (ACT 12). The upstream side sensor 46 outputs an upstream-side detection signal.

Figure 7:
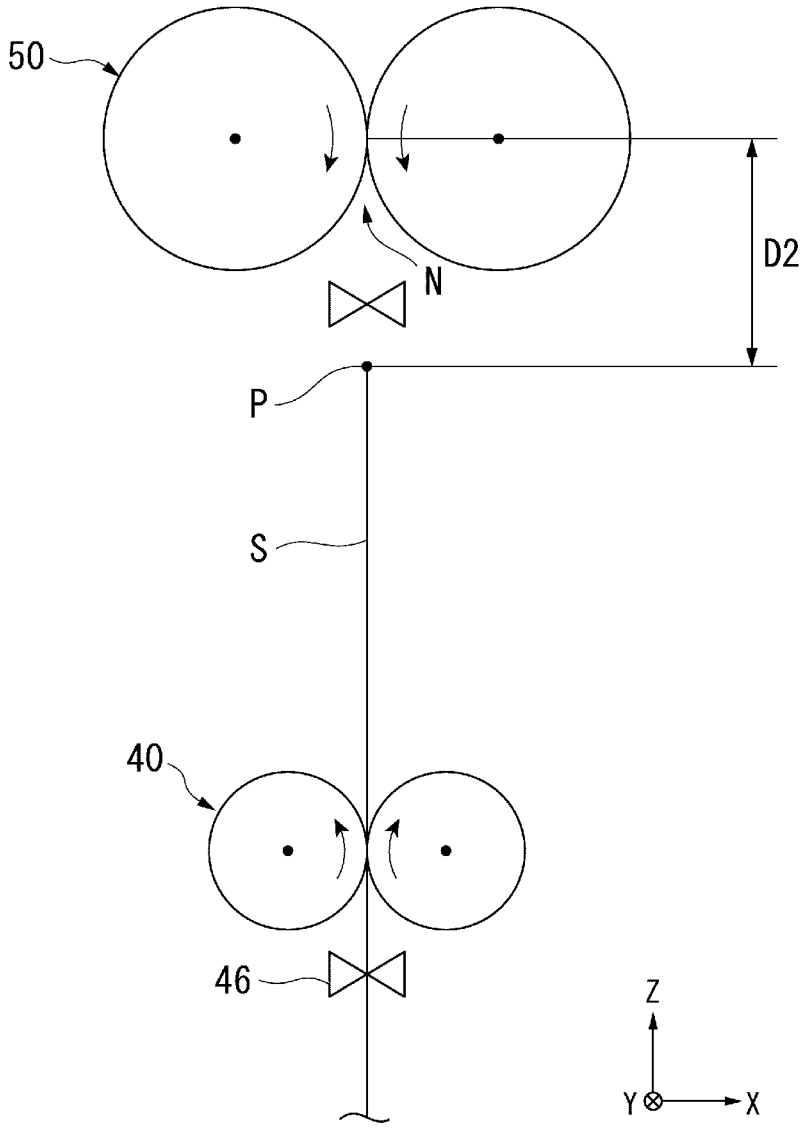

As illustrated in FIG. 7, the sheet-conveyance control section 60 determines whether or not the leading end of the sheet S reached the predetermined position P (ACT 14). The predetermined position P is a position apart from the nip N of the alignment roller 50 in −Z direction by the second distance D2. If the determination in ACT 14 is Yes, the sheet-conveyance control section 60 starts reverse rotation of the alignment roller 50 (ACT 16).

Figure 8:
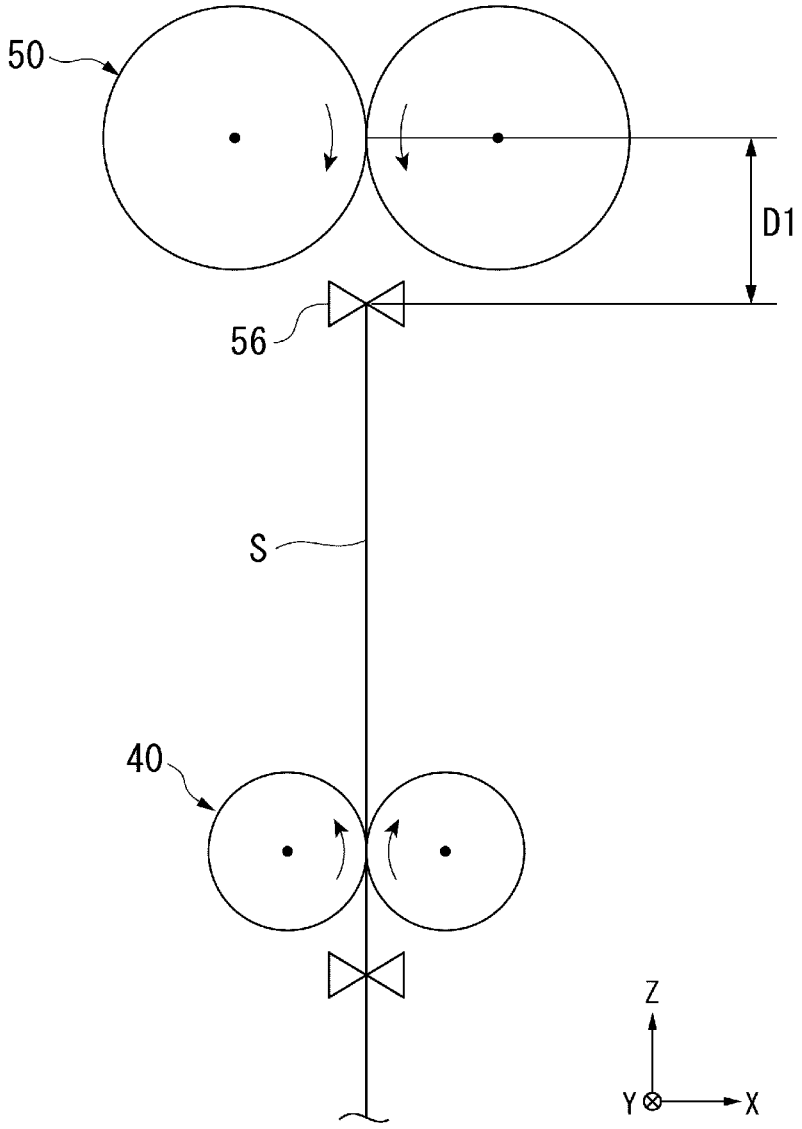

As illustrated in FIG. 8, if the leading end of the sheet S reaches the downstream side sensor 56, the downstream side sensor 56 is turned on (ACT 18). The downstream side sensor 56 outputs a downstream-side detection signal. The sheet-conveyance control section 60 rotates the conveyance roller 40 in the forward direction to convey the sheet S in +Z direction by a predetermined distance after receiving the downstream-side detection signal. The predetermined distance is a distance obtained by adding the bend forming distance to the first distance D1.

Figure 9:
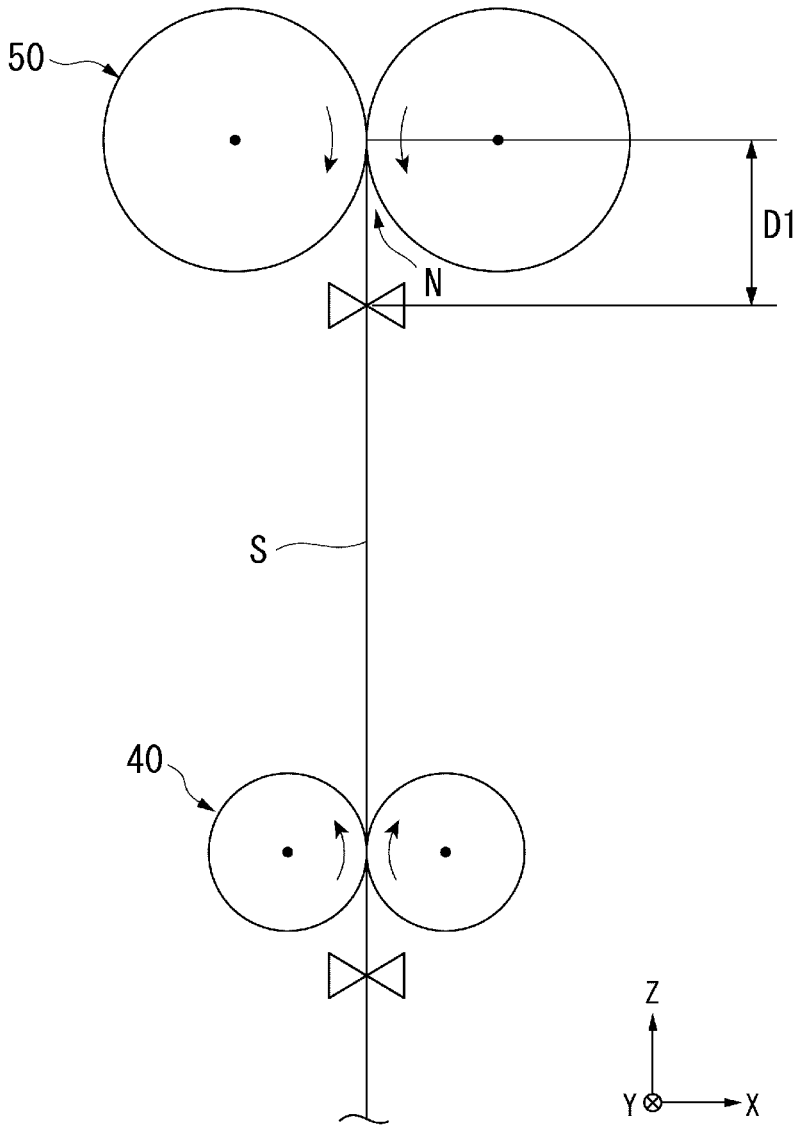

As illustrated in FIG. 9, if the sheet S is conveyed by the first distance D1, the leading end of the sheet S comes into contact with the nip N of the alignment roller 50. The leading end of the sheet S may come into contact with the nip N in a state in which the leading end of the sheet S is inclined. At this time, the alignment roller 50 is reversely rotating. For that reason, a corner C of the leading end is prevented from intruding in +Z direction beyond the nip N as indicated by a sheet S2 illustrated in FIG. 4. That is, the sheet S is disposed in −Z direction of the nip N without being held by the nip N.

Figure 10:
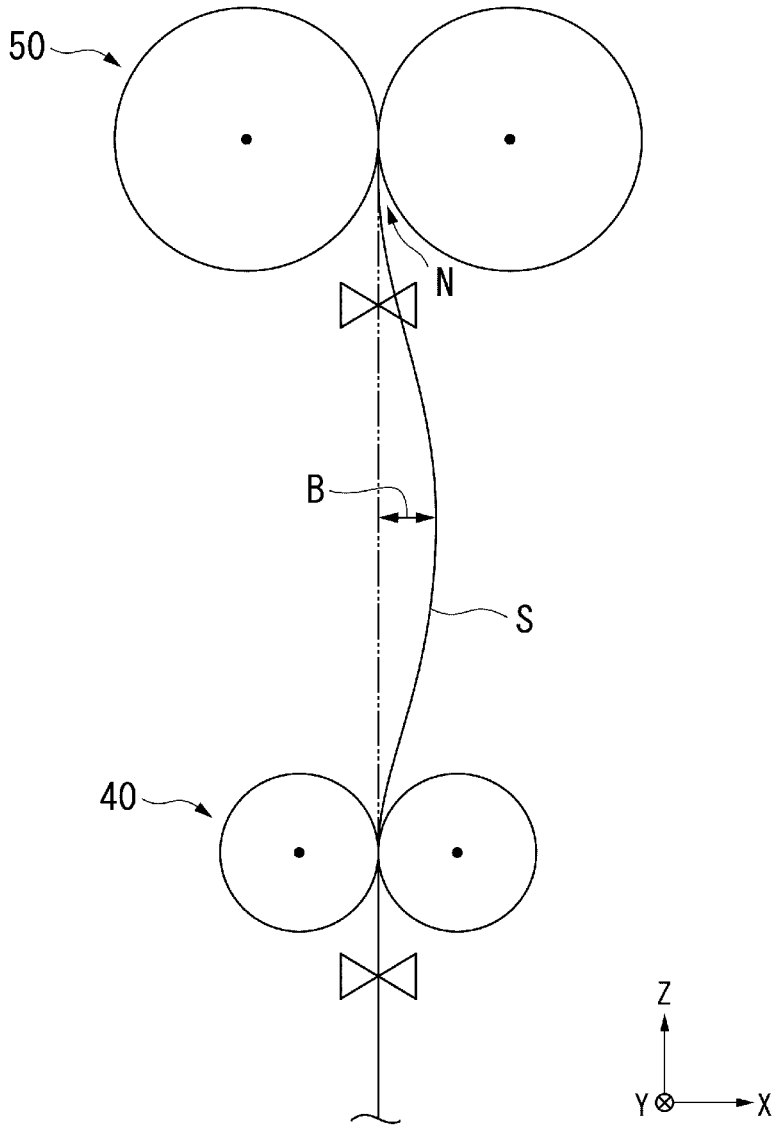

As illustrated in FIG. 10, if the sheet S is conveyed beyond the first distance D1, a bend B is formed in the sheet S. As explained above, the sheet S is located in −Z direction of the nip N without being held by the nip N. For that reason, the posture of the leading end of the sheet S can be easily changed. The leading end can be turned around X axis. Therefore, if the bend B is formed in the sheet S, the inclination of the leading end of the sheet S is aligned along the nip N.

In this way, the bend B is formed in the sheet S while the alignment roller 50 is reversely rotating. Consequently, compared with when the bend B is formed in the sheet S while the alignment roller 50 is stopped, a coefficient of friction between the alignment roller 50 and the sheet S is smaller. For that reason, the orientation of the leading end of the sheet S can be easily changed. Therefore, the inclination of the leading end of the sheet S is aligned along the nip N.

The sheet-conveyance control section 60 determines whether or not the sheet S is conveyed by the predetermined distance after receiving the downstream-side detection signal (ACT 20). If the determination in ACT 20 is Yes, as illustrated in FIG. 10, the sheet-conveyance control section 60 stops the reverse rotation of the alignment roller 50 and the forward rotation of the conveyance roller 40 (ACT 22).

Figure 11:
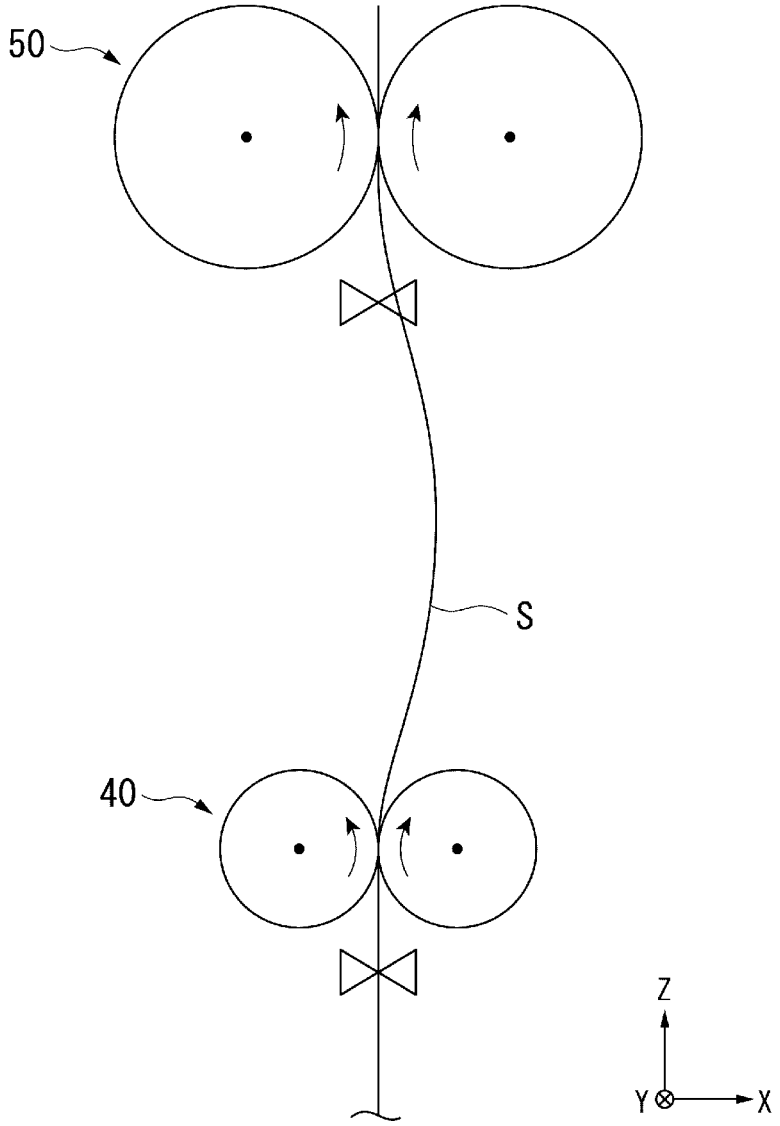

As illustrated in FIG. 11, the sheet-conveyance control section 60 starts forward rotation of the alignment roller 50 and the conveyance roller 40 at predetermined timing (ACT 24). The predetermined timing is timing when conveyance of the sheet S is started according to the transfer of the toner image onto the sheet S by the image forming unit 3. Consequently, the sheet-conveyance control section 60 conveys the sheet S to the image forming unit 3.

The speed of the forward rotation of the alignment roller 50 is higher than the speed of the reverse rotation of the alignment roller 50. The alignment roller 50 is normally rotated at high speed, whereby the sheet S is quickly conveyed toward the image forming unit 3. On the other hand, even if the speed of the reverse rotation of the alignment roller 50 is low, intrusion of the leading end of the sheet S into the nip N is prevented.

The processing of the sheet conveying method according to the first embodiment ends.

As explained above in detail, the sheet conveying device 5 according to the first embodiment includes the conveyance roller 40, the alignment roller 50, and the sheet-conveyance control section 60. The conveyance roller 40 is capable of performing forward rotation for moving the sheet S in +Z direction. The alignment roller 50 is disposed in +Z direction of the conveyance roller 40. The alignment roller 50 is capable of performing the forward rotation and reverse rotation for moving the sheet S in −Z direction. The sheet-conveyance control section 60 reversely rotates the alignment roller 50 in a state in which the conveyance roller 40, which holds the sheet S, is rotated in the forward direction.

The sheet-conveyance control section 60 reversely rotates the alignment roller 50 in a state in which the leading end of the sheet S is contact with the alignment roller 50 and the bend B is formed in the sheet S in X direction.

Since the alignment roller 50 is reversely rotated, the sheet S is disposed in −Z direction of the nip N without being held by the nip N. For that reason, the orientation of the leading end of the sheet S can be easily changed. Consequently, the leading end of the sheet S is aligned along the nip N in a state in which the bend B is formed. Therefore, aligning performance of the sheet conveying device 5 can be improved.

The sheet conveying device 5 includes, in a position apart from the alignment roller 50 in −Z direction by the first distance D1, the downstream side sensor 56 that detects passage of the leading end of the sheet S. The sheet-conveyance control section 60 rotates the conveyance roller 40 in the forward direction to convey the sheet S by a predetermined distance after the downstream side sensor 56 detects the passage of the leading end of the sheet S. The sheet-conveyance control section 60 forms the bend B of the sheet S in X direction. The predetermined distance is a distance obtained by adding the bend forming distance to the first distance D1.

According to this configuration, the bend B of the sheet S can be stably formed.

The sheet-conveyance control section 60 starts reverse rotation of the alignment roller 50 at a point in time when the leading end of the sheet S reaches the predetermined position P. The predetermined position P is a position apart from the alignment roller 50 in −Z direction by the second distance D2.

Before the leading end of the sheet S comes into contact with the nip N of the alignment roller 50, the reverse rotation of the alignment roller 50 is started. Therefore, the leading end of the sheet S is prevented from intruding in +Z direction beyond the nip N.

The sheet conveying device 5 includes, in a position apart from the alignment roller 50 in −Z direction by the third distance D3, the upstream side sensor 46 that detects passage of the leading end of the sheet S. If a predetermined time period elapses after the upstream side sensor 46 detects the passage of the leading end of the sheet S, the sheet-conveyance control section 60 determines that the leading end of the sheet S reaches the predetermined position P. The predetermined time period is a time period during which the conveyance roller 40 performs the forward rotation 40*f* to convey the sheet S in +Z direction by the difference distance Dg. The difference distance Dg is a difference between the third distance D3 and the second distance D2.

According to this configuration, the reverse rotation of the alignment roller 50 can be stably started.

The sheet-conveyance control section 60 sets the second speed lower than the first speed. The first speed is speed of the reverse rotation of the alignment roller 50 in conveying the first sheet. The second speed is speed of the reverse rotation of the alignment roller 50 in conveying the thick second sheet thicker than the first sheet.

Since the speed of the reverse rotation of the alignment roller 50 in conveying the thick second sheet is low, separation of the second sheet in the thickness direction can be prevented.

The speed of the forward rotation of the alignment roller 50 is higher than the speed of the reverse rotation of the alignment roller 50.

The alignment roller 50 rotates at high speed, whereby the sheet S is quickly conveyed toward the image forming unit 3. On the other hand, even if the speed of the reverse rotation of the alignment roller 50 is low, intrusion of the leading end of the sheet S into the nip N is prevented.

The sheet-conveyance control section 60 starts reverse rotation of the alignment roller 50 at a point in time when the leading end of the sheet S reaches the predetermined position P. In the first embodiment, the predetermined position P is a position apart from the nip N of the alignment roller 50 in −Z direction by the second distance D2. On the other hand, the predetermined position P may be a position apart from the end portion in −Z direction of the alignment roller 50 in −Z direction by a fourth distance. The fourth distance is not limited to a positive value and may be a negative value. If the fourth distance is the negative value, the size of the fourth distance is smaller than the radius of the alignment roller 50. The predetermined position P in this case may be within a range from the nip N of the alignment roller 50 to the end portion in −Z direction.

In the first embodiment, the sheet-conveyance control section 60 sets the speed of the reverse rotation of the alignment roller 50 in conveying the second sheet thicker than the first sheet lower than the first speed. The leading end of the thick second sheet is less likely to intrude in +Z direction beyond the nip N. Therefore, if the thick second sheet is conveyed, the sheet-conveyance control section 60 may not carry out the reverse rotation of the alignment roller 50.

In contrast, the leading end of a third sheet thinner than the first sheet is more likely to intrude in +Z direction beyond the nip N. Therefore, the sheet-conveyance control section 60 may set the speed of the reverse rotation of the alignment roller 50 in conveying the thin third sheet higher than the first speed. The sheet-conveyance control section 60 may set a time of the reverse rotation of the alignment roller 50 long.

Second Embodiment

In the sheet conveying method according to the first embodiment, reverse rotation of the alignment roller 50 is started before the leading end of the sheet S reaches the nip N of the alignment roller 50. In contrast, in a sheet conveying method according to a second embodiment, reverse rotation of the alignment roller 50 is started after the bend B is formed in the sheet S. In the second embodiment, description of the same elements as the elements in the first embodiment is omitted.

As illustrated in FIG. 3, the sheet-conveyance control section 60 receives the downstream-side detection signal output from the downstream side sensor 56. The sheet-conveyance control section 60 rotates the conveyance roller 40 in the forward direction to convey the sheet S in +Z direction by a predetermined distance after receiving the downstream-side detection signal. The predetermined distance is a distance obtained by adding the bend forming distance to the first distance D1. The conveyance roller 40 conveys the sheet S beyond the first distance D1, whereby a bend is formed in the sheet S.

The sheet-conveyance control section 60 according to the second embodiment maintains the alignment roller 50 in a stopped state while the conveyance roller 40 conveys the sheet S by the predetermined distance.

The sheet-conveyance control section 60 according to the second embodiment starts the reverse rotation 50*b* of the alignment roller 50 at a point in time when the conveyance roller 40 conveys the sheet S by the predetermined distance. That is, the sheet-conveyance control section 60 starts the reverse rotation 50*b* of the alignment roller 50 in a state in which the leading end of the sheet S is in contact with the alignment roller 50 and the bend B of the sheet S is formed in X direction. The sheet-conveyance control section 60 continues the reverse rotation 50*b* of the alignment roller 50 for more than a predetermined time period. The predetermined time period is a time period necessary for causing the alignment roller 50 to perform the reverse rotation 50*b* and moving the sheet S in −Z direction by the bend forming distance.

Figure 12:
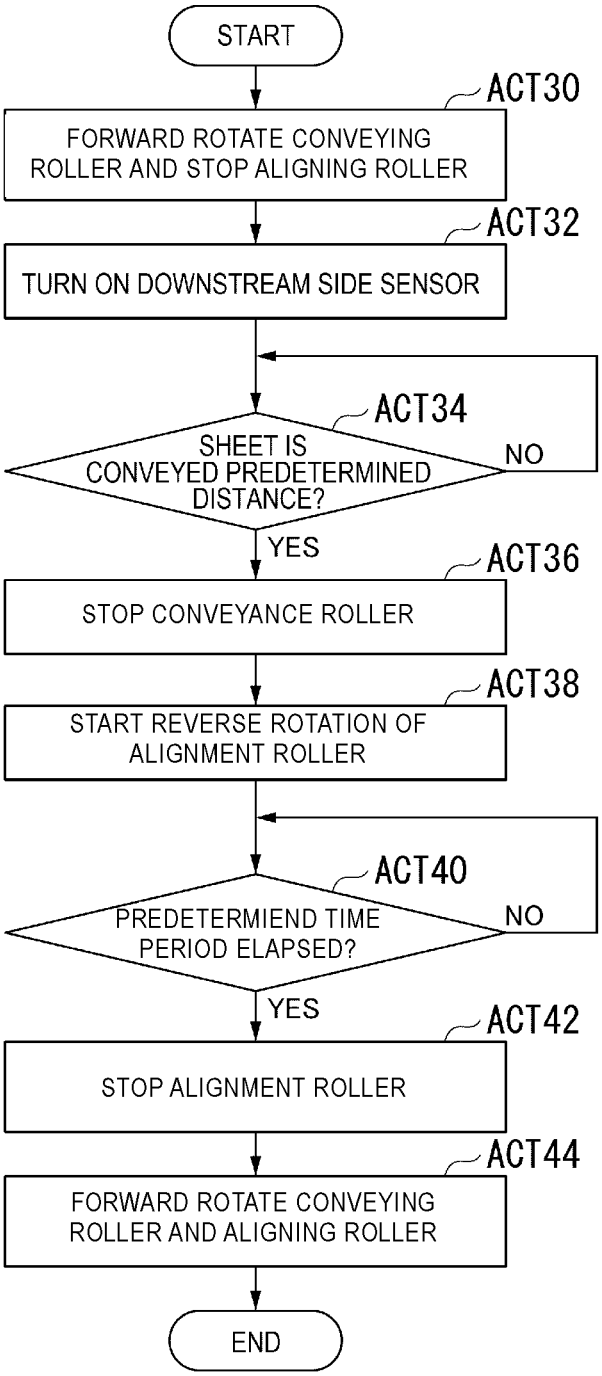
FIG. 12 is a flowchart of a sheet conveying method according to a second embodiment.

FIG. 12 is a flowchart of a sheet conveying method according to the second embodiment. FIGS. 13-17 illustrate a sequence of sheet conveyance according to the sheet conveying method of the second embodiment.

Figure 13:
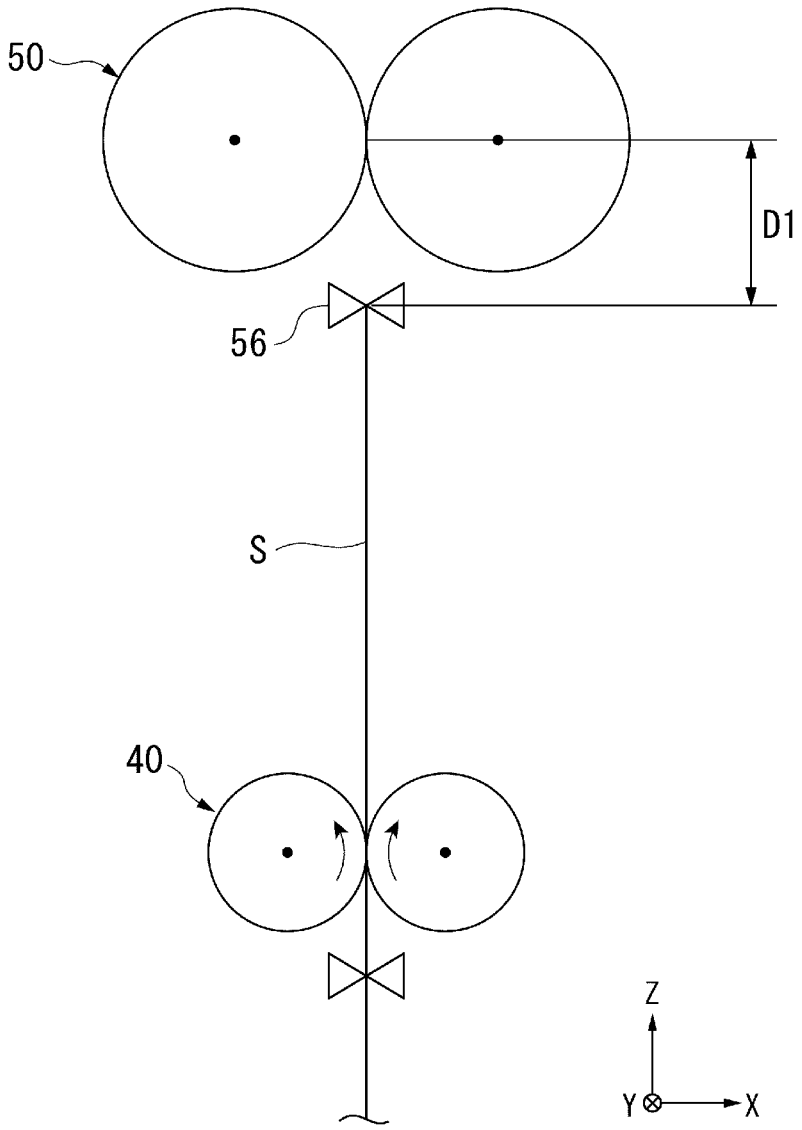
FIGS. 13-17 illustrate a sequence of sheet conveyance according to the sheet conveying method according to the second embodiment.

When receiving a printing command, the sheet-conveyance control section 60 conveys the sheet S in +Z direction. That is, as illustrated in FIG. 13, the sheet-conveyance control section 60 rotates the conveyance roller 40 in the forward direction. At this time, the sheet-conveyance control section 60 stops the alignment roller 50 (ACT 30).

As illustrated in FIG. 13, if the leading end of the sheet S reaches the downstream side sensor 56, the downstream side sensor 56 is turned on (ACT 32). The downstream side sensor 56 outputs a downstream-side detection signal. The sheet-conveyance control section 60 rotates the conveyance roller 40 in the forward direction to convey the sheet S in +Z direction by a predetermined distance after receiving the downstream-side detection signal. The predetermined distance is a distance obtained by adding the bend forming distance to the first distance D1.

Figure 14:
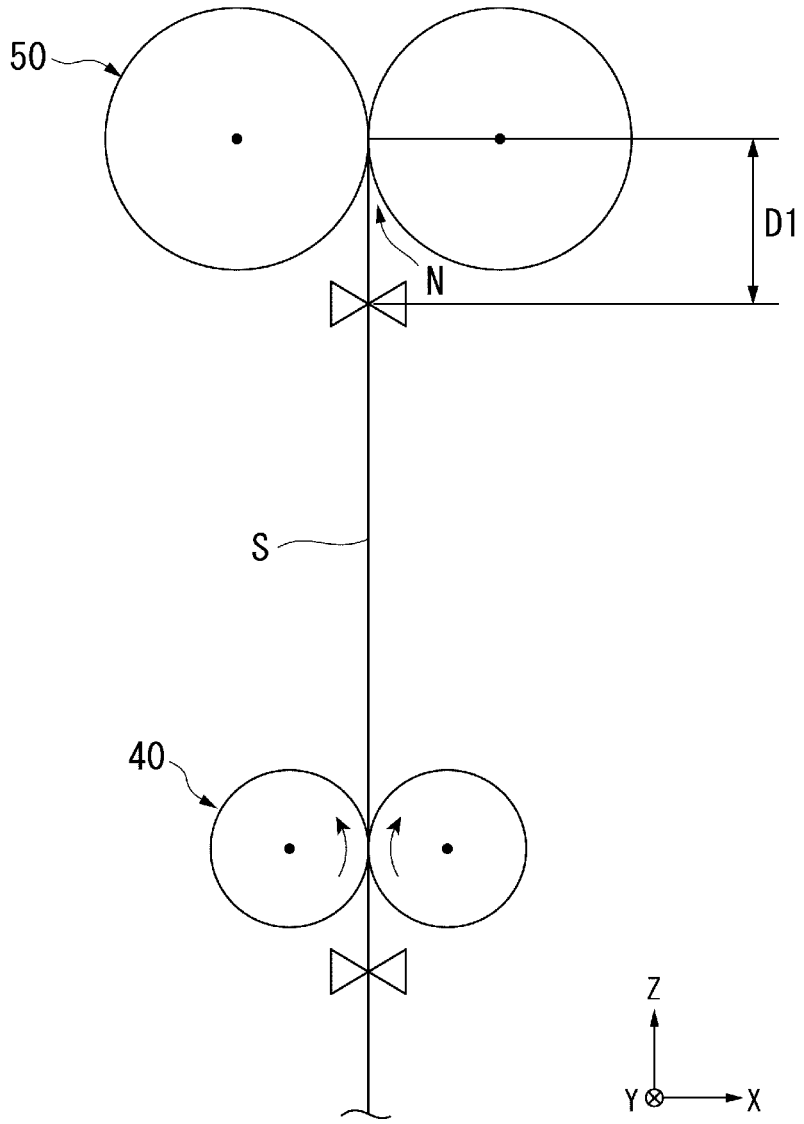

As illustrated in FIG. 14, if the sheet S is conveyed by the first distance D1, the leading end of the sheet S comes into contact with the nip N of the alignment roller 50. The leading end of the sheet S sometimes comes into contact with the nip N in a state in which the leading end of the sheet S is inclined. At this time, the alignment roller 50 is stopped. For that reason, the corner C of the leading end is likely to intrude in +Z direction beyond the nip N as indicated by the sheet S2 illustrated in FIG. 4.

Figure 15:
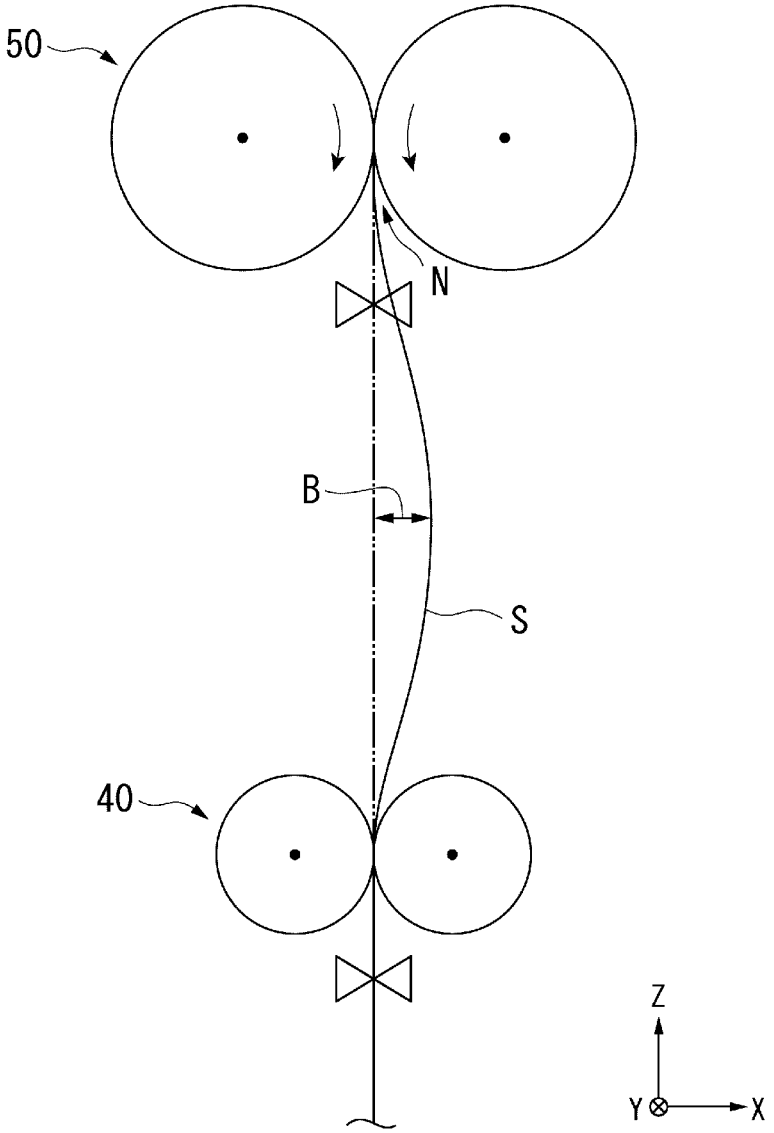

As illustrated in FIG. 15, if the sheet S is conveyed beyond the first distance D1, the bend B is formed in the sheet S. The sheet-conveyance control section 60 determines whether or not the sheet S conveyed by the predetermined distance after receiving the downstream-side detection signal (ACT 34). If the determination in ACT 34 is Yes, the sheet-conveyance control section 60 stops the forward rotation of the conveyance roller 40 (ACT 36). Further, the sheet-conveyance control section 60 starts reverse rotation of the alignment roller 50 (ACT 38).

As explained above, the corner of the leading end of the sheet S is likely to intrude in +Z direction beyond the nip N. Even in that case, the sheet S moves in −Z direction of the nip N according to the reverse rotation of the alignment roller 50. The orientation of the leading end of the sheet S can be easily changed. Since the bend B is formed in the sheet S, the leading end of the sheet S is aligned along the nip N.

The sheet-conveyance control section 60 determines whether or not the reverse rotation of the alignment roller 50 is continued for a predetermined time period (ACT 40). The predetermined time period is a time period necessary for reversely rotating the alignment roller 50 and moving the sheet S in −Z direction by the bend forming distance. A distance in which the leading end of the sheet S intrudes in +Z direction beyond the nip N is equal to or smaller than the bend forming distance. The alignment roller 50 is reversely rotated for more than the predetermined time period, whereby the leading end of the sheet S moves in −Z direction of the nip N.

Figure 16:
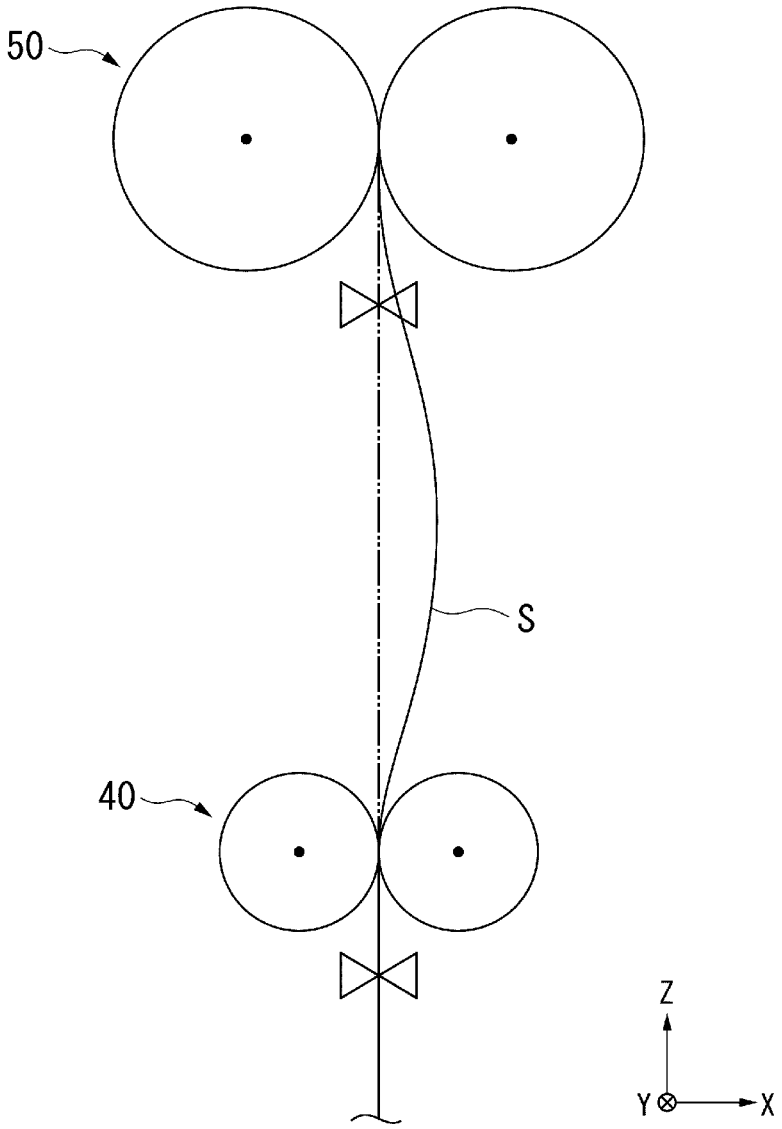

If the determination in ACT 40 is Yes, as illustrated in FIG. 16, the sheet-conveyance control section 60 stops the reverse rotation of the alignment roller 50 (ACT 42).

Figure 17:
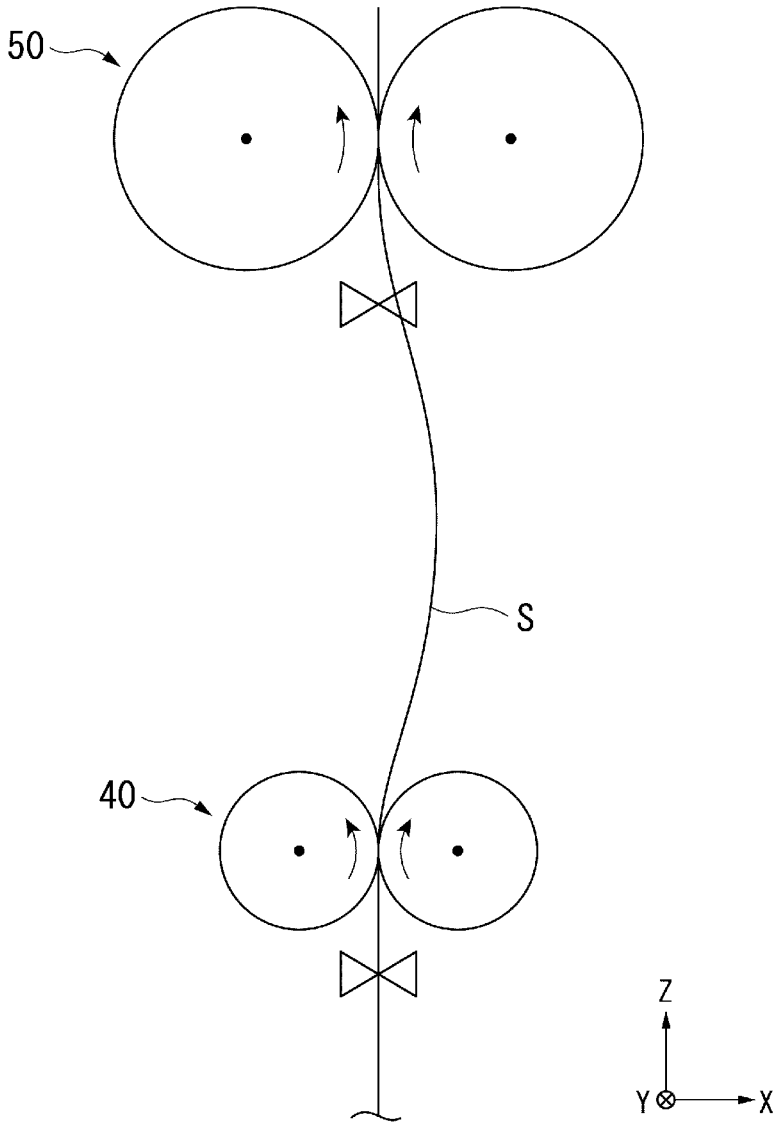

As illustrated in FIG. 17, the sheet-conveyance control section 60 starts forward rotation of the alignment roller 50 and the conveyance roller 40 at predetermined timing (ACT 44). The predetermined timing is timing when conveyance of the sheet S is started according to the transfer of the toner image onto the sheet S by the image forming unit 3. Consequently, the sheet-conveyance control section 60 conveys the sheet S to the image forming unit 3.

The speed of the forward rotation of the alignment roller 50 is higher than the speed of the reverse rotation of the alignment roller 50. The alignment roller 50 rotates in the forward direction at a high speed, whereby the sheet S is quickly conveyed toward the image forming unit 3. On the other hand, even if the speed of the reverse rotation of the alignment roller 50 is low, the leading end of the sheet S moves in −Z direction of the nip N.

The processing of the sheet conveying method according to the second embodiment ends.

As explained above in detail, the sheet-conveyance control section 60 starts reverse rotation of the alignment roller 50 in a state in which the leading end of the sheet S is in contact with the alignment roller 50 and the bend B of the sheet S is formed in X direction.

Even if the leading end of the sheet S intrudes in +Z direction beyond the nip N, the alignment roller 50 is reversely rotated, whereby the leading end of the sheet S moves in −Z direction of the nip N. Since the reverse rotation of the alignment roller 50 is started in a state in which the sheet S bends, a reverse rotation time of the alignment roller 50 decreases. Consequently, power consumption of the sheet conveying device 5 can be reduced.

The sheet-conveyance control section 60 reversely rotates the alignment roller 50 until a predetermined time period elapses after the reverse rotation of the alignment roller 50 is started. The predetermined time period is a time period during which the alignment roller 50 is reversely rotated to move the sheet S in −Z direction by a distance exceeding the bending forming distance.

The distance in which the leading end of the sheet S intrudes in +Z direction beyond the nip N is equal to or smaller than the bend forming distance. The alignment roller 50 is reversely rotated for more than the predetermined time period, whereby the leading end of the sheet S moves in −Z direction of the nip N.

The sheet conveying device 5 in the embodiment is applied to the image forming apparatus 1, which is an example of the image processing apparatus. On the other hand, the sheet conveying apparatus 5 may be applied to a decoloring apparatus, which is another example of the image processing apparatus. The decoloring apparatus performs, on the sheet S on which an image is formed with decoloring toner, processing for decoloring the image on the sheet S.

According to the at least one embodiment explained above, the sheet conveying device 5 includes the sheet-conveyance control section 60. The sheet-conveyance control section 60 reversely rotates the alignment roller 50 in a state in which the conveyance roller 40, which holds the sheet S, is rotated in the forward direction. Consequently, it is possible to improve aligning performance of the sheet conveying device 5.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet conveying device comprising:

a first roller configured to rotate in a forward direction for sheet conveyance along a sheet conveying direction;

a second roller disposed downstream with respect to the first roller in the sheet conveying direction and configured to rotate in a forward direction along the sheet conveying direction and in a reverse direction; and a controller configured to control the second roller to start rotating in the reverse direction before a leading end of a sheet that is nipped and conveyed by the first roller reaches a nip of the second roller, a rotation speed of the second roller in the reverse direction being at a first speed when the sheet has a first thickness and at a second speed lower than the first speed when the sheet has a second thickness greater than the first thickness.

2. The sheet conveying device according to claim 1, wherein the controller is further configured to control the first roller to rotate in the forward direction while the second roller rotates in the reverse direction after the leading end of the sheet reaches the nip of the second roller, such that the sheet is bent in a thickness direction of the sheet.

3. The sheet conveying device according to claim 1, wherein a period of time during which the first roller rotates in the forward direction while the second roller rotates in the reverse direction after the leading end of the sheet reaches the nip of the second roller is a first period of time when the sheet has the first thickness and a second period of time less than the first period of time when the sheet has the second thickness.

4. The sheet conveying device according to claim 1, further comprising:

a sheet sensor disposed between the first roller and the second roller, wherein the controller is further configured to control the first roller to rotate in the forward direction by a predetermined amount greater than a distance between the sheet sensor and the nip of the second roller while the second roller rotates in the reverse direction after detection of the leading end of the sheet by the sheet sensor, such that the leading end of the sheet reaches the second roller and then the sheet is bent in a thickness direction of the sheet.

5. The sheet conveying device according to claim 4, further comprising:

a second sheet sensor disposed upstream the sheet sensor in the sheet conveying direction, wherein the controller is configured to determine a position of the leading end of the sheet based on detection of the leading end of the sheet by the second sheet sensor, and control the second roller to start rotating in the reverse direction upon determining that the leading end of the sheet reached a predetermined position between the first roller and the second roller.

6. The sheet conveying device according to claim 4, wherein the controller is further configured to control the first roller to stop rotating after the first roller has rotated in the forward direction by the predetermined amount.

7. The sheet conveying device according to claim 6, wherein the controller is further configured to control the second roller to stop rotating after the first roller has rotated in the forward direction by the predetermined amount.

8. The sheet conveying device according to claim 7, wherein the controller is further configured to control the first and second rollers to rotate in the forward direction after rotations of the first and second rollers are stopped.

9. The sheet conveying device according to claim 1, wherein the controller is further configured to control a rotation speed of the second roller in the reverse direction to be slower than a rotation speed of the second roller in the forward direction.

10. The sheet conveying device according to claim 1, wherein the rotation speed of the second roller in the reverse direction is at a third speed faster than the first speed when the sheet has a third thickness less than the first thickness.

11. The sheet conveying device according to claim 1, wherein the controller is further configured to control the second roller to rotate in the forward direction at a fourth speed after the leading end of the sheet reaches the nip of the second roller and the sheet is aligned, the fourth speed being greater than the first speed and the second speed.

12. A sheet conveying device comprising:

a first roller configured to rotate in a forward direction for sheet conveyance along a sheet conveying direction;

a second roller disposed downstream with respect to the first roller in the sheet conveying direction and configured to rotate in a forward direction along the sheet conveying direction and in a reverse direction; and a controller configured to control the second roller to start rotating in the reverse direction before a leading end of a sheet that is nipped and conveyed by the first roller reaches a nip of the second roller, when the sheet has a first thickness, wherein the second roller does not rotate in the reverse direction before the leading end of the sheet that is nipped and conveyed by the first roller reaches the nip of the second roller, when the sheet has a second thickness greater than the first thickness.

13. The sheet conveying device according to claim 12, wherein when the sheet has the first thickness, the controller is further configured to control the first roller to rotate in the forward direction while the second roller rotates in the reverse direction after the leading end of the sheet reaches the nip of the second roller, such that the sheet is bent in a thickness direction of the sheet.

14. The sheet conveying device according to claim 12, further comprising:

a sheet sensor disposed between the first roller and the second roller, wherein when the sheet has the first thickness, the controller is further configured to control the first roller to rotate in the forward direction by a predetermined amount greater than a distance between the sheet sensor and the nip of the second roller while the second roller rotates in the reverse direction after detection of the leading end of the sheet by the sheet sensor, such that the leading end of the sheet reaches the second roller and then the sheet is bent in a thickness direction of the sheet.

15. The sheet conveying device according to claim 14, further comprising:

a second sheet sensor disposed upstream the sheet sensor in the sheet conveying direction, wherein when the sheet has the first thickness, the controller is configured to determine a position of the leading end of the sheet based on detection of the leading end of the sheet by the second sheet sensor, and control the second roller to start rotating in the reverse direction upon determining that the leading end of the sheet reached a predetermined position between the first roller and the second roller.

16. The sheet conveying device according to claim 14, wherein when the sheet has the first thickness, the controller is further configured to control the first roller to stop rotating after the first roller has rotated in the forward direction by the predetermined amount.

17. The sheet conveying device according to claim 16, wherein when the sheet has the first thickness, the controller is further configured to control the second roller to stop rotating after the first roller has rotated in the forward direction by the predetermined amount.

18. The sheet conveying device according to claim 17, wherein when the sheet has the first thickness, the controller is further configured to control the first and second rollers to rotate in the forward direction after rotations of the first and second rollers are stopped.

19. The sheet conveying device according to claim 12, wherein the controller is further configured to control a rotation speed of the second roller in the reverse direction to be slower than a rotation speed of the second roller in the forward direction.

20. The sheet conveying device according to claim 12, wherein the controller is further configured to control the second roller to start rotating in the reverse direction before the leading end of the sheet that is nipped and conveyed by the first roller reaches the nip of the second roller, when the sheet has a third thickness less than the first thickness, and a rotation speed of the second roller in the reverse direction is at a first speed when the sheet has the first thickness and at a second speed faster than the first speed when the sheet has the third thickness.

* * * * *